US007342595B2

(12) United States Patent
Chang et al.

(10) Patent No.: US 7,342,595 B2
(45) Date of Patent: Mar. 11, 2008

(54) APPARATUS AND METHOD FOR DRIVING PLASMA DISPLAY PANEL

(75) Inventors: Geun-Yeong Chang, Suwon-si (KR); Woo-Jin Kim, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 634 days.

(21) Appl. No.: 10/992,210

(22) Filed: Nov. 19, 2004

(65) Prior Publication Data

US 2005/0140593 A1 Jun. 30, 2005

(30) Foreign Application Priority Data

Nov. 22, 2003 (KR) ..... 10-2003-0083362

(51) Int. Cl.
*G09G 5/10* (2006.01)

(52) U.S. Cl. ..... 345/690; 345/63

(58) Field of Classification Search ..... 345/63, 345/690, 60

See application file for complete search history.

(56) References Cited

U.S. PATENT DOCUMENTS 6,249,265 B1 * 6/2001 Tajima et al. ..... 345/63
6,924,778 B2 * 8/2005 Awamoto et al. ..... 345/60
7,095,888 B2 * 8/2006 Kim ..... 382/162
7,161,607 B2 * 1/2007 Choi ..... 345/690
2002/0175922 A1 * 11/2002 Koo et al. ..... 345/589
2003/0169217 A1 * 9/2003 Kang et al. ..... 345/63

FOREIGN PATENT DOCUMENTS

JP 2001-022318 1/2001

* cited by examiner

*Primary Examiner*—Kent Chang
(74) *Attorney, Agent, or Firm*—H.C. Park & Associates, PLC

(57) ABSTRACT

A method and apparatus for driving a plasma display panel that automatically controls power using an average signal level that is compensated based on a difference between power consumption at red (R), green (G), and blue (B) discharge cells. The method includes calculating R, G, and B average signal levels, calculating a compensated average signal level using the R, G, and B average signal levels and R, G, and B weights, and controlling the number of discharges for each frame, which is in inversely proportional to the compensated average signal level. The R, G, and B weights are set at a value that reduces a difference between power consumption at the R, G, and B colored discharge cells when displaying the R, G, and B colors in a case where the R, G, and B average signal levels are equal to each other.

10 Claims, 9 Drawing Sheets

| WEIGHT | 1 : 1 : 1 | | | |
|---|---|---|---|---|
| LOAD RATIO | R | G | B | VARIATION(MAX) |
| 0 | 166 | 166 | 166 | 0 |
| 10 | 195 | 195 | 201 | 6 |
| 20 | 225 | 228 | 242 | 17 |
| 30 | 255 | 263 | 280 | 25 |
| 40 | 255 | 266 | 285 | 30 |
| 50 | 246 | 260 | 280 | 34 |
| 60 | 242 | 256 | 275 | 33 |
| 70 | 235 | 253 | 271 | 36 |
| 80 | 235 | 253 | 270 | 35 |
| 90 | 234 | 250 | 270 | 36 |
| 100 | 225 | 247 | 266 | 41 |
| | | | AVERAGE | 26.63636 |

| WEIGHT | 1 : 1.154 : 1.296 | | | |
|---|---|---|---|---|
| LOAD RATIO | R | G | B | VARIATION(MAX) |
| 0 | 165 | 165 | 165 | 0 |
| 10 | 190 | 198 | 201 | 11 |
| 20 | 220 | 230 | 238 | 18 |
| 30 | 249 | 263 | 274 | 25 |
| 40 | 276 | 270 | 266 | 10 |
| 50 | 267 | 263 | 256 | 11 |
| 60 | 262 | 260 | 255 | 7 |
| 70 | 257 | 254 | 250 | 7 |
| 80 | 257 | 253 | 249 | 8 |
| 90 | 254 | 253 | 247 | 7 |
| 100 | 253 | 248 | 246 | 7 |
| | | | AVERAGE | 10.09091 |

APPARATUS AND METHOD FOR DRIVING PLASMA DISPLAY PANEL

CROSS REFERENCE TO RELATED APPLICATION

This application claims priority to and the benefit of Korean Patent Application No. 10-2003-0083362, filed on Nov. 22, 2003, which is hereby incorporated by reference for all purposes as if fully set forth herein.

BACKGROUND OF THE INVENTION

1. Field of the Invention

The present invention relates to an apparatus and a method for driving a plasma display panel (PDP), and more particularly, to an apparatus and a method for driving a PDP that automatically controls power using a compensated average signal level to minimize differences between power consumption of red, green, and blue discharge cells.

2. Discussion of the Related Art

FIG. 1 is a perspective view showing a structure of a typical three-electrode surface discharging type PDP.

Referring to FIG. 1, the PDP 1 includes a front glass substrate 10 and a rear glass substrate 13. Address electrodes $A_{R1}$, $A_{G1}$, . . . , $A_{Gm}$, $A_{Bm}$, dielectric layers 11 and 15, Y electrode lines $Y_1$, . . . , $Y_n$, X electrode lines $X_1$, . . . , $X_n$, a phosphor layer 16, a barrier rib 17, and an MgO protective layer 12 are disposed between the front and rear glass substrates 10 and 13.

The address electrode lines $A_{R1}$, $A_{G1}$, . . . , $A_{Gm}$, $A_{Bm}$ are formed on the rear glass substrate 13, and the lower dielectric layer 15 covers them. The barrier ribs 17 are formed on the lower dielectric layer 15 in between, and in parallel to, the address electrode lines $A_{R1}$, $A_{G1}$, . . . , $A_{Gm}$, $A_{Bm}$, and they divide a discharging region of each display cell and prevent optical cross talk between cells. The phosphor layer 16 is formed on the lower dielectric layer 15 and on the sides of the barrier ribs 17.

The X electrode lines $X_1$, . . . , $X_n$ and the Y electrode lines $Y_1$, . . . , $Y_n$ are formed orthogonally to the address electrode lines $A_{R1}$, $A_{G1}$, . . . , $A_{Gm}$, $A_{Bm}$ on a lower surface of the front glass substrate 10. Crossing points of a pair of X and Y electrodes and an address electrode form display cells. The upper dielectric layer 11 covers the X electrode lines $X_1$, . . . , $X_n$ and the Y electrode lines $Y_1$, . . . , $Y_n$. The protective layer 12, which is typically made of a MgO layer, protects the PDP 1 from a strong electric field. It is formed on, and covers, the upper dielectric layer 11. A plasma forming gas is filled in the discharge space 14.

U.S. Pat. No. 5,541,618 discloses an address-display separation (ADS) driving method that is often used as the driving method of a typical PDP.

FIG. 2 is a block diagram showing a driving apparatus 2 of the PDP shown in FIG. 1.

Referring to FIG. 2, the driving apparatus 2 includes an image processor 26, a logic controller 22, an address driver 23, an X driver 24, and a Y driver 25. The image processor 26 converts external analog image signal into internal image signals, such as 8 bit red (R), green (G), and blue (B) image data, clock signals, and vertical and horizontal synchronization signals. The logic controller 22 generates driving control signals $S_A$, $S_Y$, and $S_X$ according to the internal image signals from the image processor 26.

Here, the address driver 23, the X driver 24, and the Y driver 25 receive the driving control signals $S_A$, $S_Y$, and $S_X$, generate the driving signals, and apply the generated driving signals to the electrode lines.

FIG. 3 is a timing view showing a typical ADS driving method of the PDP shown in FIG. 1.

Referring to FIG. 3, a unit frame is divided into 8 sub-fields $SF_1$, . . . , $SF_8$ for time division gray scale display. Each sub-field $SF_1$~$SF_8$ may be divided into a reset period $R_1$, . . . , $R_8$, an address period $A_1$~$A_8$, and a sustain period $S_1$~$S_8$.

PDP brightness is in proportion to lengths of the sustain periods $S_1$~$S_8$ in the unit frame, and the length of the sustain periods $S_1$~$S_8$ in the unit frame is 255 T (T denotes a unit time). Time corresponding to $2^{n-1}$ may be set for the sustain period $S_n$ in nth sub-filed $SF_n$. Accordingly, by selecting appropriate sub-fields, 256 gray levels, including 0 gray level, may be displayed.

FIG. 4 is a timing view showing typical driving signals applied to the electrode lines of the PDP shown in FIG. 1 in the unit sub-field $SF_n$ of FIG. 3.

Referring to FIG. 4, $S_{AR1}$, . . . , $S_{ABm}$ denote the driving signals applied to the address electrode lines ($A_{R1}$, $A_{B1}$, . . . , $A_{Gm}$, $A_{Bm}$ of FIG. 1), $S_{X1}$, . . . $S_{Xn}$ denote the driving signals applied to the X electrode lines ($X_1$, . . . , $X_n$ in FIG. 1), and $S_{Y1}$, . . . , $S_{Yn}$ denote the driving signals applied to the Y electrode lines ($Y_1$, . . . , $Y_n$ in FIG. 1).

Referring to FIG. 4, in the reset period PR of the unit sub-field, a voltage applied to the X-electrode lines $X_1$, . . . , $X_n$ rises from a ground voltage $V_G$ to a first voltage $V_e$. During this time, ground voltages $V_G$ are applied to the Y-electrode lines $Y_1$, . . . , $Y_n$ and the address electrode lines $A_{R1}$, . . . , $A_{Bm}$.

Then, a voltage applied to the Y-electrode lines $Y_1$, . . . , $Y_n$ rises from the second voltage $V_S$, to the voltage ($V_{SET}$+$V_S$). During this time, the ground voltages $V_G$ are applied to the X-electrode lines $X_1$, . . . , $X_n$ and the address electrode lines $A_{R1}$, . . . , $A_{Bm}$.

Next, with the voltage of $V_e$ applied to the X-electrode lines $X_1$, . . . , $X_n$, the voltage applied to the Y-electrode lines $Y_1$, . . . , $Y_n$ falls from the second voltage $V_S$ to the ground voltage $V_G$. During this time, the ground voltage $V_G$ is applied to the address electrode lines $A_{R1}$, . . . , $A_{Bm}$.

In the following address period PA, display data signals are applied to the address electrode lines, and scan signals of ground voltages $V_G$ are sequentially applied to the Y-electrode lines $Y_1$, . . . , $Y_n$, which are biased to be fourth voltages ($V_{SCAN}$). The first voltage $V_e$ is applied to the X-electrode lines $X_1$, . . . , $X_n$ during the address period PA.

In the following sustain period PS, sustain discharge pulses of the second voltage $V_S$ are alternately applied to the Y-electrode lines $Y_1$, . . . , $Y_n$ and the X-electrode lines $X_1$, . . . , $X_n$ to display images on the discharging cells that were selected during the previous address period (PA).

FIG. 5 is a graph showing general automatic power control (APC) principles that may be utilized in driving a PDP.

Referring to FIG. 5, according to the general APC method, the number of discharge cells that are turned on among all discharge cells on the panel controls the number of sustain pulses that are applied in the sustain period of one unit frame. The number of sustain pulses at the unit frame is in inverse-proportion to the load ratio. That is, if the load ratio is small, the number of sustain pulses in the unit frame increases, thus improving the brightness of the displayed image, and if the load ratio is high, the number of sustain pulses at the unit frame decreases, thus reducing power consumption.

On the other hand, an average signal level (ASL) is an average of all signal levels applied to the discharge cells for displaying gray level per frame. Thus the average signal level has the same meaning as load ratio, but a unit of the average signal level differs from a unit of the load ratio. Hence, "load ratio" and "average signal level" may be used interchangeably herein. The ASL of the unit frame may be calculated by dividing an accumulated signal level of all discharge cells forming the panel by the number of entire discharge cells. The discharge cells may display R, G and B colors.

R, G, and B discharge cells with the same ASLs may have different power consumption due to various elements such as asymmetric cell structure. Thus, power consumption may differ by gray level when driving a PDP according to the APC method.

That is, in cases of full red, full green, and full blue colors, the power consumption of the R, G, and B discharge cells may differ even though they have the same ASLs. Thus, desired power consumption may not be obtained according to the conventional APC method.

FIG. 6 and FIG. 7 show power consumption with respect to the red, green, and blue colors in an asymmetric panel according to the conventional APC driving method.

FIG. 6 and FIG. 7 show cases where the red, green, and blue colors are displayed while the load ratio is increased from 0% to 100% by 10% according to the conventional APC method. As these figures show, power consumption may be different according to the displayed colors even with the same load ratios.

SUMMARY OF THE INVENTION

The present invention provides an apparatus and a method for driving a PDP that automatically controls power using an average signal level that is compensated considering differences between R, G, and B discharge cells.

Additional features of the invention will be set forth in the description which follows, and in part will be apparent from the description, or may be learned by practice of the invention.

The present invention discloses a method for driving a plasma display panel, which includes red (R), green (G), and blue (B) colored discharge cells, by dividing an image signal having R, G, and B colors and dividing each frame into a plurality of sub-fields, wherein the number of discharge operations is inversely proportional to an average signal level. The method includes calculating a R, G, and B average signal level, calculating a compensated average signal level, and controlling the number of discharges for each frame based on the compensated average signal level. The R, G, and B average signal levels are averages of signal levels applied to R, G, and B discharge cells per frame, respectively. The compensated average signal level is determined using the R, G, and B average signal levels and R, G, and B weights.

The present invention also discloses an apparatus for driving a plasma display panel, which includes red (R), green (G), and blue (B) colored discharge cells, by dividing an image signal having R, G, and B colors into frames, and dividing each frame into a plurality of sub-fields, wherein the number of discharge operations is inversely proportional to an average signal level. The apparatus includes an average signal level calculator, a compensated average signal level calculator, and an automatic power control data generator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 8:
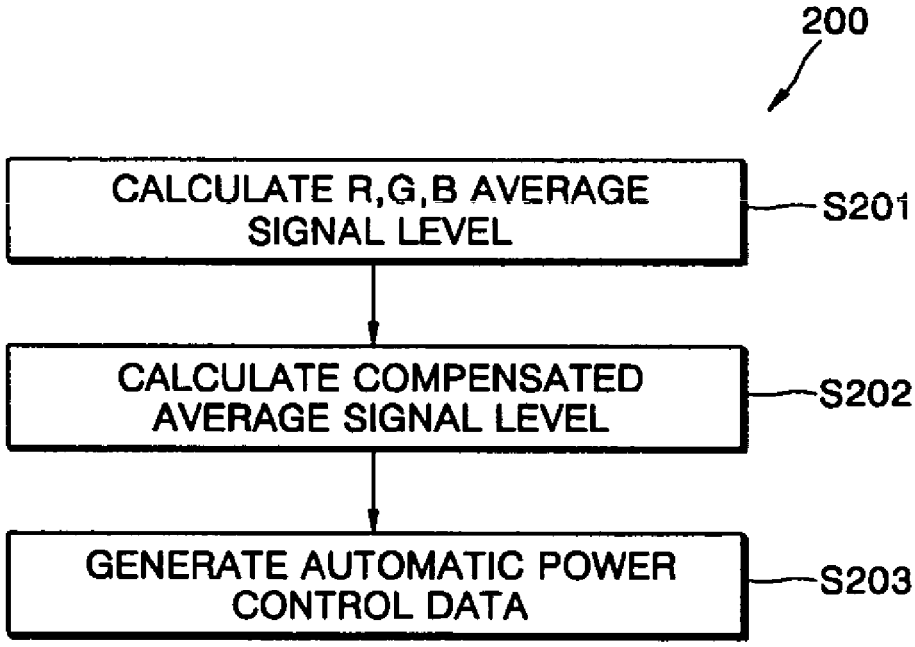
FIG. 8 is a block diagram showing a PDP driving method according to an exemplary embodiment of the present invention.
Figures 9, 10:
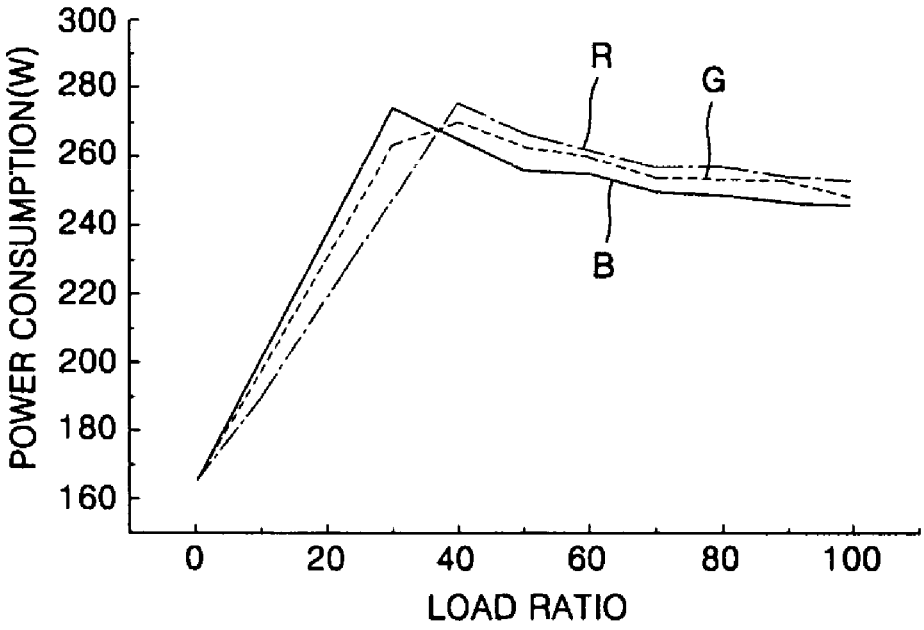
FIG. 9 and FIG. 10 show power consumption of R, G, and B discharge cells in an asymmetrically structured PDP according to the driving method shown in FIG. 8.

FIG. 8 is a block diagram showing a PDP driving method according to an exemplary embodiment of the present invention. FIG. 9 and FIG. 10 show power consumption at R, G, and B discharge cells in an asymmetrically structured PDP according to a PDP driving method of an exemplary embodiment of the present invention.

Referring to FIG. 8, a PDP driving method according to an exemplary embodiment of the present invention includes calculating an average signal level of R, G, and B discharge cells (S201), calculating a compensated ASL (S202), and generating APC data (S203).

Widths of the R, G, and B discharge cells may differ so that they emit equally bright light. Hence, R, G, and B discharge cells may be formed asymmetrically.

The asymmetrical structure of the R, G, and B discharge cells may cause different power consumption for the discharge cells under equal average signal levels according to the conventional driving method of the PDP.

An APC operation may be performed to control the power consumption. The average signal level, which is an average of signal levels applied to all discharge cells, is estimated by frame unit, and APC data that controls the discharge times at the each frame to be in inverse proportion to the estimated average signal level is generated. Accordingly, the APC data determines the number of sustain pulses to be applied in the sustain period of the sub-field.

In step S201, a R average signal level, a G average signal level, and a B average signal level are calculated based on an internal image signal.

The internal image signal is formed from the combination of R, G, and B colors, and it is processed and separated into separate R, G, and B image signals to calculate the R, G, and B average signal levels. The R, G, and B average signal levels may be calculated after gamma correcting and error diffusing the image signal.

The R average signal level is the average of signal level applied to all R discharge cells, the G average signal level is the average of signal level applied to all G discharge cells, the B average signal level is the average of signal level applied to all B discharge cells.

In steps S202, the compensated ASL ($ASL_W$) may be calculated by summing products of the R, G, and B average signal levels and R, G, and B weights, respectively, and dividing the summed products by a sum of the R, G, and B weights, as shown in following equation.

$$ASLw = \frac{Wr \times ASLr + Wg \times ASLg + Wb \times ASLb}{Wr + Wg + Wb}, \quad (1)$$

where $ASL_r$ is the R average signal level, $ASL_g$ is the G average signal level, $ASL_b$ is the B average signal level, $W_r$ is a R weight, $W_g$ is a G weight, and $W_b$ is a B weight.

In step S203, the APC data that controls the number of sustain discharges $N_s$ in the unit frame, which is in inverse proportion to the compensated ASL ($ASL_W$), is generated. An APC table that allocates the number of sustain discharges $N_s$ to each frame is generated, and the APC data is calculated from the APC table.

The power consumption may be set using the compensated ASL ($ASL_W$). In the present exemplary embodiment, the power consumption Pw may be calculated using the compensated ASL ($ASL_W$) and the number of sustain discharges $N_s$ at the each frame using following equations.

$$Pw=(A+B\times Ns)\times ASLw+(C+D\times Ns) \quad (2)$$

$$Pi=(C+D\times Ns) \quad (3)$$

$$P(ASLw)=(A+B\times Ns)\times ASLw \quad (4)$$

In Equation 3, $P_i$ is an initial power consumption, and in Equation 4, $P(ASL_W)$ is pure power consumption for displaying the R, G, and B colors. A, B, C, and D are coefficients calculated through experiments. Since the power consumption Pi may not be related to the input data, the power consumption of the R, G, and B input data may be linearly related to the R, G, and B weights $W_r$, $W_g$, and $W_b$.

It is desirable to set the R, G, and B weights $W_r$, $W_g$, and $W_b$ to minimize the difference between power consumption when displaying the full red, full green, and full blue screens under equal average signal levels $ASL_r$, $ASL_g$, and $ASL_b$.

In the exemplary embodiment shown in FIG. 9 and FIG. 10, the R, G, and B weights $W_r$, $W_g$, and $W_b$ are in a relation of 1:1.154:1.296. FIG. 9 shows the power consumption in displaying the full red, full green, and full blue screens, and maximum variations between the power consumptions, when using a PDP driving method according to an exemplary embodiment of the present invention.

Figures 5, 6:
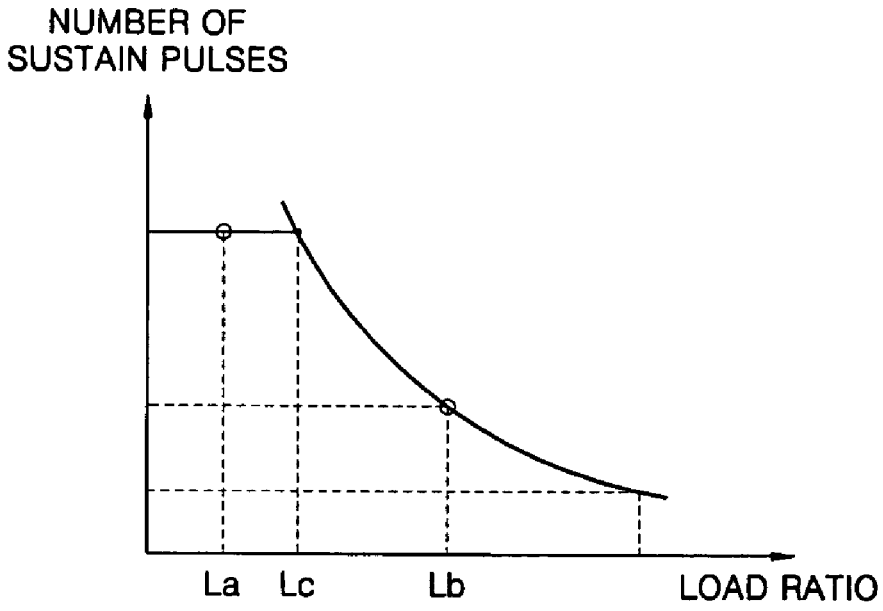
FIG. 5 (PRIOR ART)
FIG. 6 (PRIOR ART)
FIG. 5 shows general APC principles that may be used when driving a PDP.
FIG. 6 and FIG. 7 show power consumption of R, G, and B discharge cells of an asymmetrically structured panel according to the APC driving method.
Figure 7:
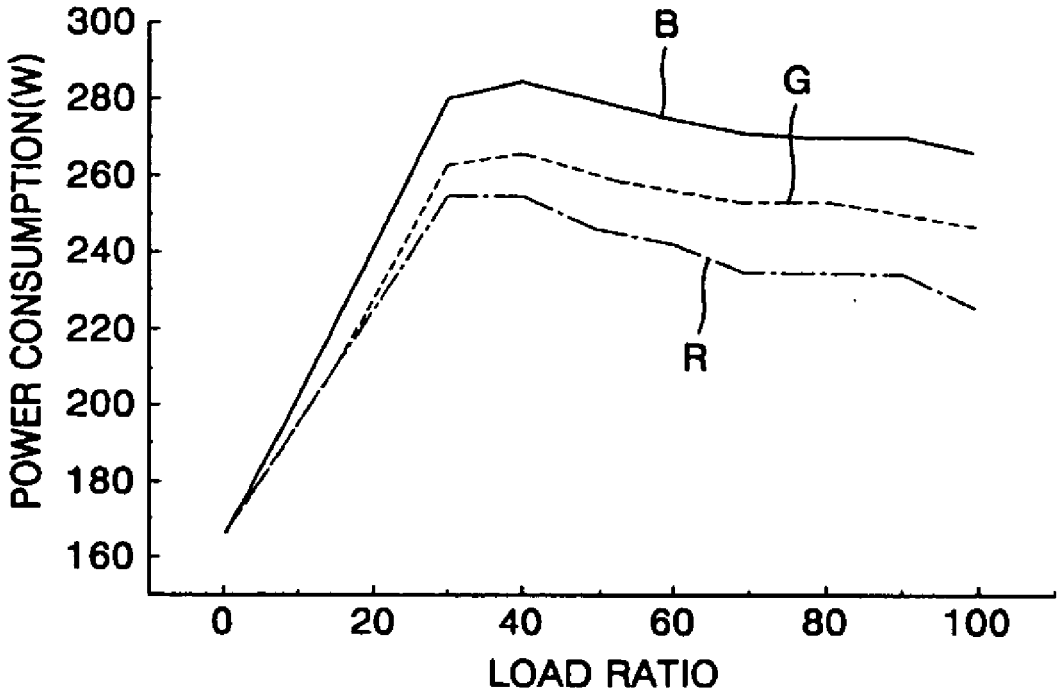
FIG. 7 (PRIOR ART)

As shown by FIG. 6 and FIG. 7, the average maximum power consumption variation without applying the weights as discussed above is 26.63636. However, as shown by FIG. 9 and FIG. 10, the average maximum power consumption variation may be 10.09091 when driving the PDP according to an exemplary embodiment of the present invention. Thus, the method of the present exemplary embodiment may significantly reduce power consumption variation among the R, G, and B discharge cells.

Figure 11:
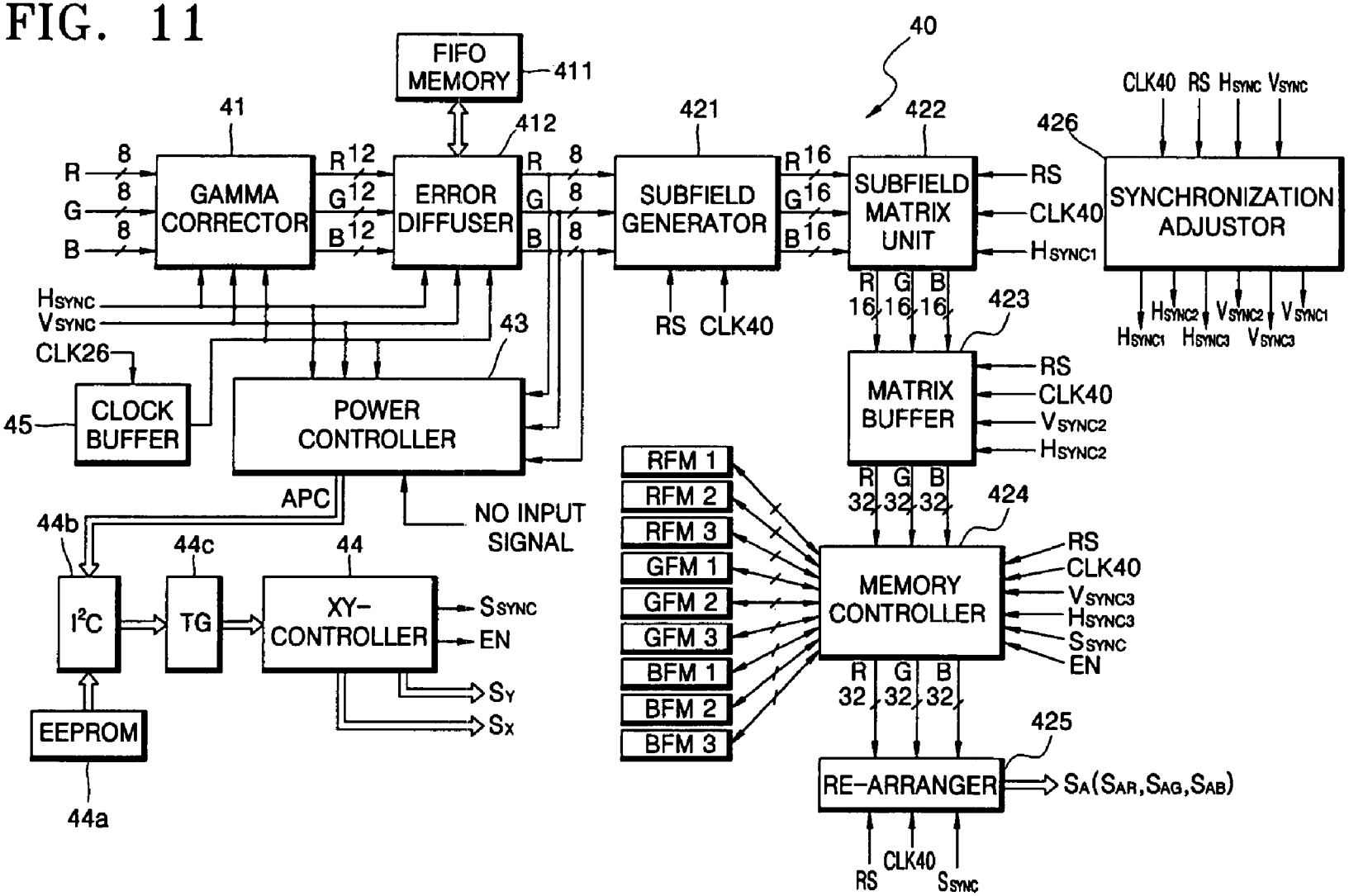
FIG. 11 is a block diagram showing a logic controller in a driving apparatus of the PDP according to another exemplary embodiment of the present invention.
Figure 12:
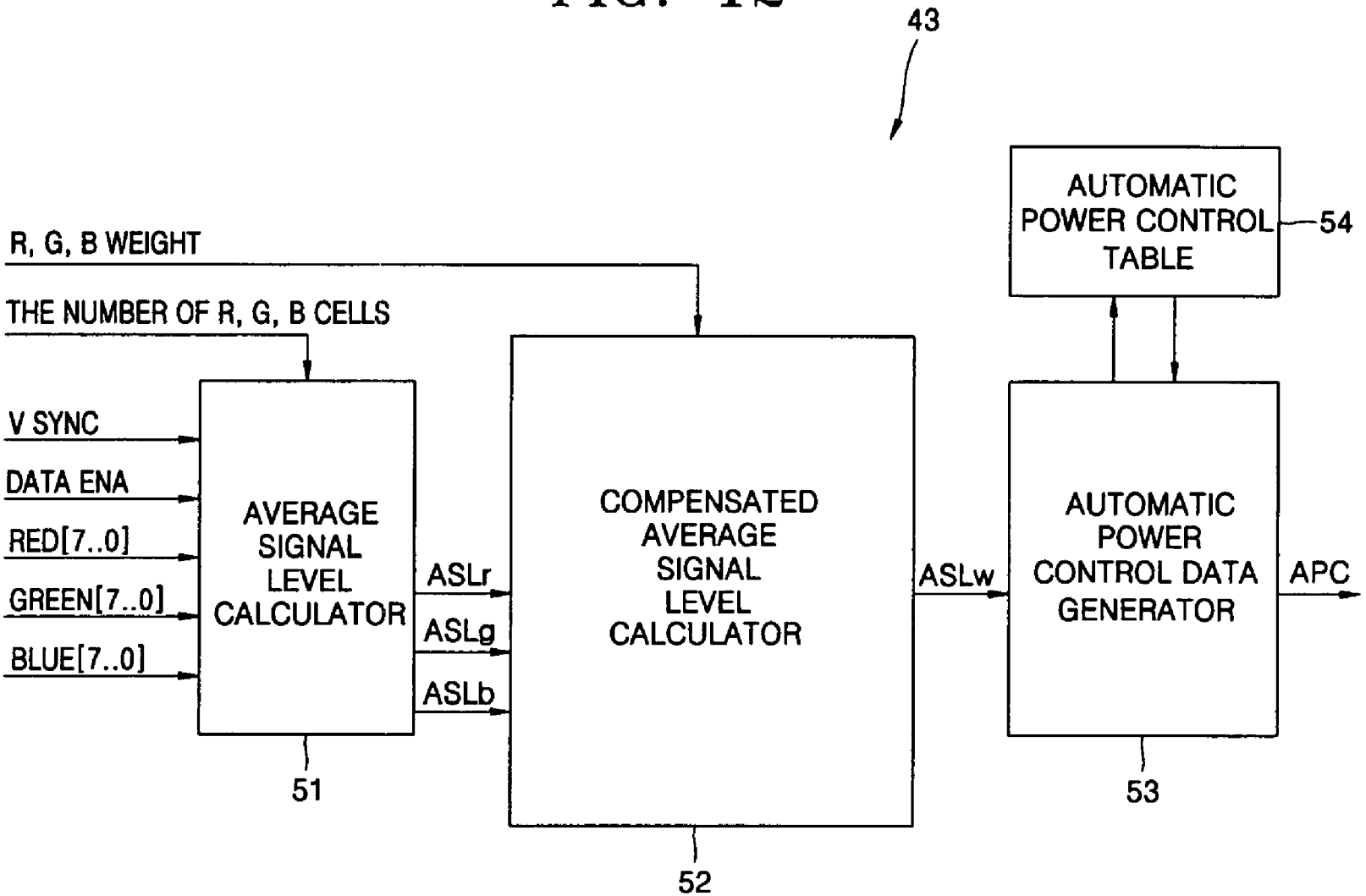
FIG. 12 is a block diagram showing a power controller of the logic controller shown in FIG. 11.

FIG. 11 is a schematic block diagram showing a logic controller of the driving apparatus for the PDP according to another exemplary embodiment of the present invention. FIG. 12 is a block diagram showing a power controller of the logic controller shown in FIG. 11.

Referring to FIG. 11 and FIG. 12, the PDP driving apparatus 40 performs the APC operation using the ASL that is compensated considering the difference between power consumption of the R, G, and B discharge cells to control power consumption variations when the colors on the screen change. The driving apparatus 40 performs the method shown in FIG. 8, and descriptions for the same elements will be omitted.

The logic controller includes a clock buffer 45, a synchronization adjustor 426, a gamma corrector 41, an error diffuser 412, a first-in-first-out (FIFO) memory 411, a sub-field generator 421, a sub-field matrix unit 422, a matrix buffer 423, a memory controller 424, frame-memories RFM1, . . . , BFM3, a re-arranger 425, a power controller 43, an EEPROM 44*a*, an $I^2C$ serial transmission interface 44*b*, a timing signal generator 44*c*, and an XY controller 44.

Figure 2:
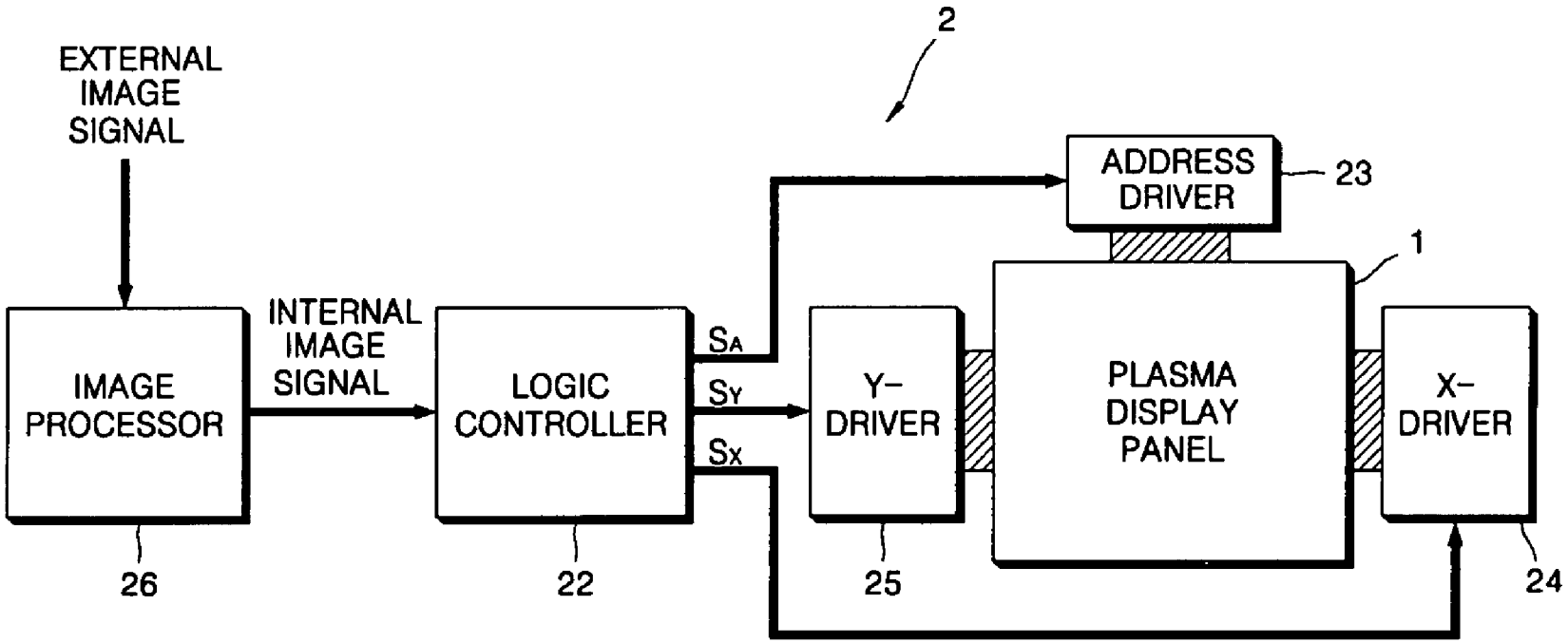
FIG. 2 (PRIOR ART)
FIG. 2 is a block diagram showing a typical driving apparatus of the PDP shown in FIG. 1.
Figure 3:
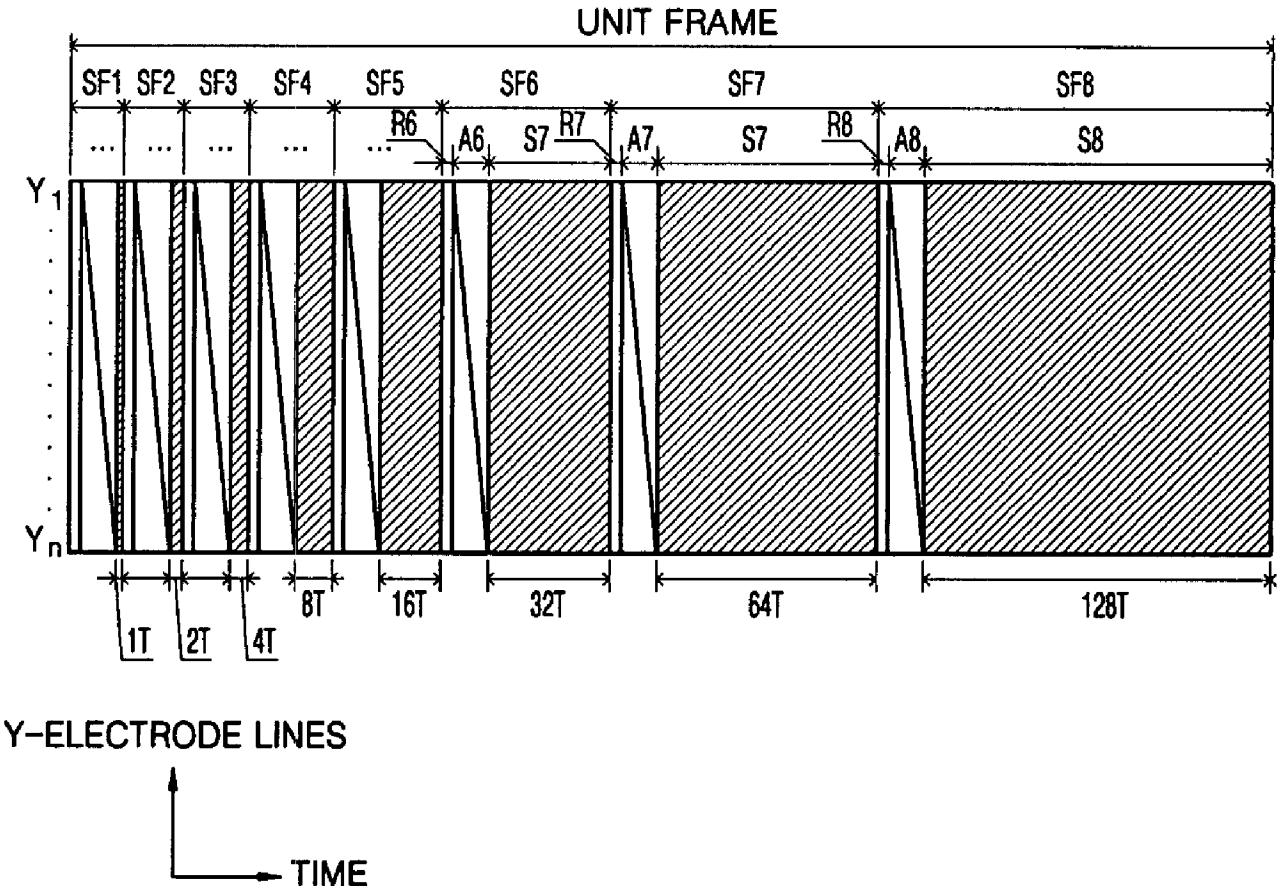
FIG. 3 (PRIOR ART)
FIG. 3 is a timing view showing a typical driving method of the PDP shown in FIG. 1.
Figure 4:
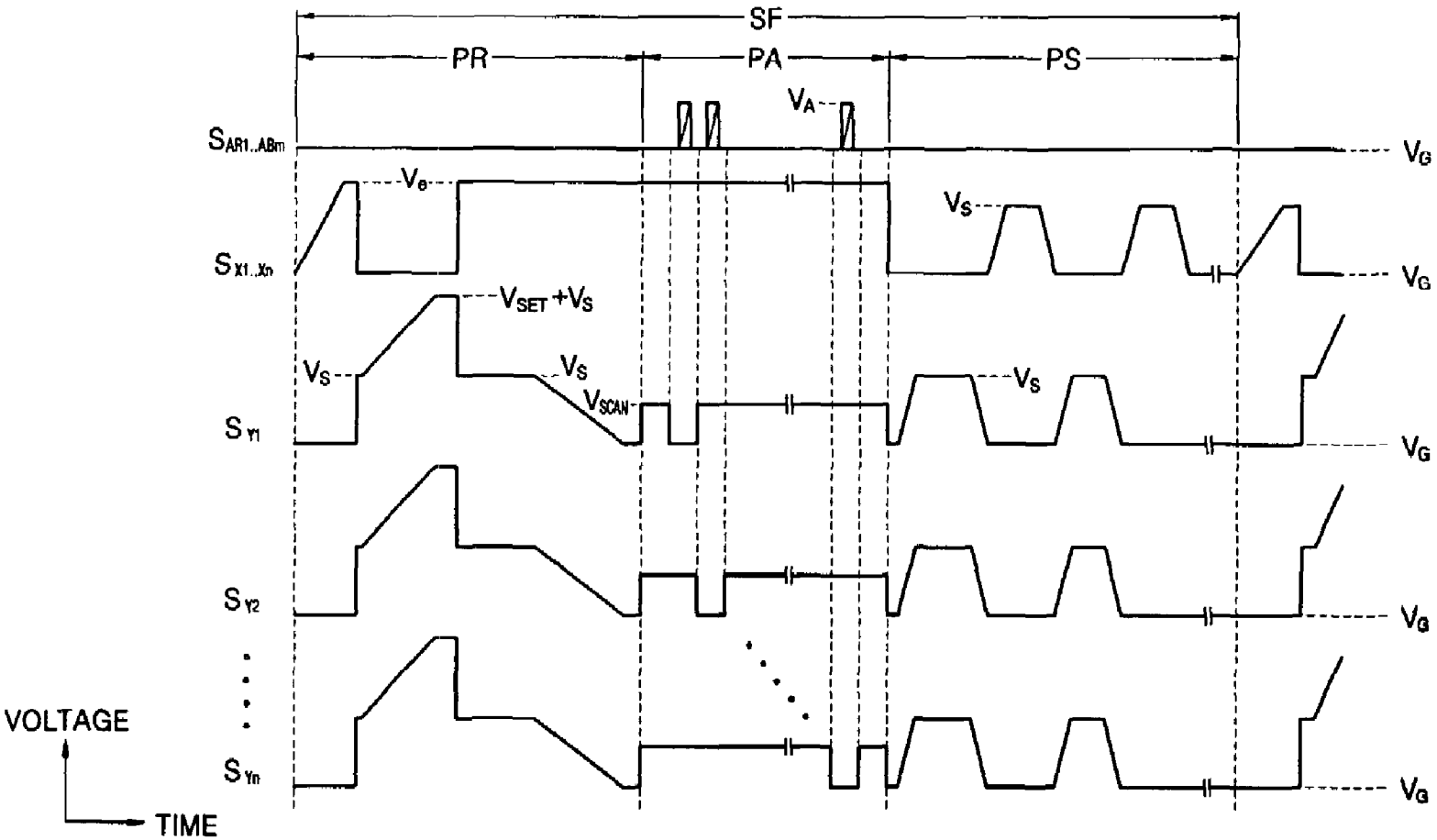
FIG. 4 (PRIOR ART)
FIG. 4 is a timing view showing typical driving signals applied to electrode lines of the PDP of FIG. 1 in a unit sub-field of FIG. 3.

The clock buffer 45 converts a clock signal of 26 MHz (CLK26) of the image processor (26 of FIG. 2) into a clock signal of 40 MHz (CLK40), and outputs the converted clock signal CLK40. The clock signal CLK40, an external initialization signal RS, a horizontal synchronization signal $H_{SYNC}$ and a vertical synchronization signal $V_{SYNC}$ are input into the synchronization adjustor 426. The synchronization adjustor 426 outputs horizontal synchronization signals $H_{SYNC1}$, $H_{SYNC2}$, and $H_{SYNC3}$, which are delayed by the predetermined number of clocks from the input horizontal synchronization signal $H_{SYNC}$, and outputs vertical synchronization signals $V_{SYNC2}$ and $V_{SYNC3}$, which are delayed by the predetermined number of clocks from the input vertical synchronization signal $V_{SYNC}$.

The R, G, and B image data input into the gamma corrector 41 have backward nonlinear input/output characteristics in order to compensate nonlinear input/output characteristics of a cathode ray tube. Therefore, the gamma corrector 41 processes the R, G, and B image data to have linear input/output characteristics. The error diffuser 412 determines locations of the most significant bit (MSB), which is a boundary bit between the R, G, and B image data, using the FIFO memory 411, thus reducing data transmission error.

The sub-field generator 421 converts 8 bit R, G, and B image data into image data having a number of bits corresponding to the number of sub-fields. For example, when the gray level is displayed with 14 sub-fields in a unit frame, sub-field generator 421 converts the 8 bit R, G, and B image data into 14 bit R, G, and B image data, and inefficient data '0' of the MSB and the least significant bit (LSB) are added to reduce a data transmission error, so that 16 bit R, G, and B image data are output.

The sub-field matrix unit 422 rearranges the 16 bit R, G, and B image data of different sub-fields, and outputs data of same sub-field simultaneously. The matrix buffer 423 processes the 16 bit R, G, and B image data input from the sub-field matrix unit 422 and outputs 32 bit R, G, and B image data.

The memory controller 424 includes an R memory controller for controlling three R frame memories RFM 1, RFM 2, and RFM 3, a G memory controller for controlling three G frame memories GFM 1, GFM 2, and GFM 3, and a B memory controller for controlling three B frame memories BFM 1, BFM 2, and BFM 3. The frame data are output from the memory controller 424, continuously in the frame unit, and input into the re-arranger 425. Reference sign EN denotes an enable signal that is generated by the XY controller 44 and input into the memory controller 424 to control its data output.

Also, $S_{SYNC}$ denotes a slot synchronization signal that is generated by the XY controller 44 and input into the memory controller 424 and the re-arranger 425 to control the data input/output of 32-bit slot unit in the memory controller 424 and the re-arranger 425. The re-arranger 425 rearranges the input 32 bit R, G, and B image data to a suitable format for the address driver (23 of FIG. 2), and outputs the data.

The power controller 43 detects the ASL by frame unit from the output R, G, and B image data of the error diffuser 412, and generates discharge time controlling data (APC) corresponding to the $ASL_W$ to perform the APC operation in order to minimize power consumption variation.

Figure 1:
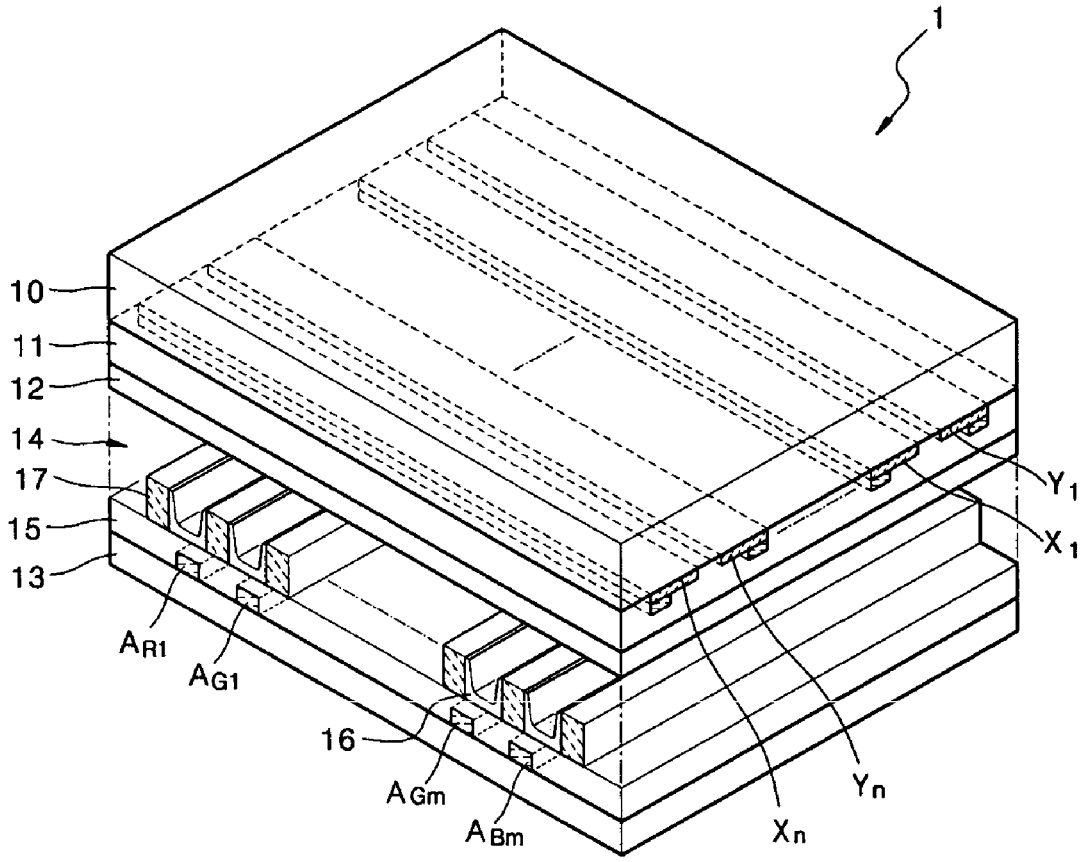
FIG. 1 (PRIOR ART)
FIG. 1 is a perspective view showing a general three-electrode surface discharge type PDP.

Additionally, the EEPROM 44*a* includes timing control data according to the driving sequences of the X electrode lines $X_1, \ldots, X_n$ of FIG. 1 and the Y electrode lines $Y_1, \ldots, Y_n$ of FIG. 1. The discharge time controlling data (APC) and the timing control data of the EEPROM 44*a* are input into the timing signal generator 44*c* through the $I^2C$ serial transmission interface 44*b*. The timing signal generator 44*c* generates the timing signal. The XY controller 44 operates according to the timing signal, and outputs the X driving control signal $S_x$ and Y driving control signal $S_y$.

As shown in FIG. 12, the power controller 43 includes an ASL calculator 51, a compensated ASL calculator 52, and an APC data generator 53.

The ASL calculator 51 calculates R, G, and B average signal levels $ASL_r$, $ASL_g$, and $ASL_b$. The compensated ASL calculator 52 calculates the compensated ASL (ASLw), which may be determined by summing the products of the R, G, and B average signal levels $ASL_r$, $ASL_g$, and $ASL_b$ and the R, G, and B weights $W_r$, $W_g$, and $W_b$ respectively, and then dividing the summed products by the sum of the weights $W_r$, $W_g$, and $W_b$, as shown in equation (1).

The APC data generator 53 generates the APC table 54 that allocates the number of discharges for each frame, and obtains the APC data related to the number of discharges for each frame corresponding to each compensated ASL level ($ASL_W$) from the APC table. The APC table 54 may be stored in the EEPROM 44*a*.

According to the driving apparatus and method of the present invention, the APC operation is performed based on an ASL that is compensated considering the differences between power consumption at the R, G, and B discharge cells to control the unbalance in power consumption caused by the change of colors on the screen.

Also, change of power consumption characteristics due to average signal level changes according to the color changes on the screen may be controlled, thus the power consumption at the R, G, and B discharge cells may be similar to each other for the same ASL.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel, which includes red (R), green (G), and blue (B) colored discharge cells, by dividing an image signal having R, G, and B colors into frames, and dividing each frame into a plurality of sub-fields, wherein the number of discharge operations is inversely proportional to an average signal level, the method comprising:

calculating a R, G, and B average signal level;

calculating a compensated average signal level; and controlling the number of discharges for each frame based on the compensated average signal level, wherein the R, G, and B average signal levels are averages of signal levels applied to R, G, and B discharge cells per frame, respectively;

wherein the compensated average signal level is determined using the R, G, and B average signal levels and R, G, and B weights.

2. The method of claim 1, wherein calculating the compensated average signal level comprises:

summing products of the R, G, and B average signal levels and the R, G, and B weights, respectively; and dividing the summed products by a sum of the R, G, and B weights.

3. The method of claim 1, wherein an automatic power control table is used when controlling the number of discharges for each frame.

4. The method of claim 3, wherein the automatic power control table allocates the number of discharges for each frame based on the compensated average signal level; and wherein automatic power control data corresponding to the compensated average signal level is obtained from the automatic power control table.

5. The method of claim 4, wherein the number of discharges for each frame is inversely proportionate to the compensated average signal level.

6. The method of claim 1, further comprising:

setting the R, G, and B weights at a value that reduces a difference between power consumption at the R, G, and B colored discharge cells when displaying the R, G, and B colors when the R, G, and B average signal levels are equal to each other.

7. An apparatus for driving a plasma display panel, which includes red (R), green (G), and blue (B) colored discharge cells, by dividing an image signal having R, G, and B colors into frames, and dividing each frame into a plurality of sub-fields, wherein the number of discharge operations is inversely proportional to an average signal level, the apparatus comprising:

an average signal level calculator that calculates a R, G, and B average signal level;

a compensated average signal level calculator; and an automatic power control data generator controlling the number of discharges for each frame based on the compensated average signal level, wherein the R, G, and B average signal levels are averages of signal levels applied to R, G, and B discharge cells per frame, respectively;

wherein the compensated average signal level is determined using the R, G, and B average signal levels and R, G, and B weights.

8. The apparatus of claim 7, wherein the compensated average signal level calculator calculates the compensated average signal level by summing products of the R, G, and B average signal levels and the R, G, and B weights, respectively, and dividing the summed products by a sum of the R, G, and B weights.

9. The apparatus of claim 7, wherein the automatic power control data generator:

forms an automatic power control table that allocates the number of discharges for frame, which is inversely proportional to the compensated average signal level, and obtains automatic power control data corresponding to the compensated average signal level from the automatic power control table.

10. The apparatus of claim 7, wherein power consumption is set by the compensated average signal level, and the R, G, and B weights are set at a value that reduces a difference between power consumption at the R, G, and B colored discharge cells when displaying the R, G, and B colors in a case where the R, G, and B average signal levels are equal to each other.

* * * * *